US005799556A

United States Patent [19]

Straub

[11] Patent Number: 5,799,556

[45] Date of Patent: Sep. 1, 1998

[54] STRIP SEVERING DEVICE FOR PAPER WEB

[75] Inventor: Karlheinz Straub, Heidenheim, Germany

[73] Assignee: Voith Sulzer Papiermaschinen GmbH, Heidenheim, Germany

[21] Appl. No.: 706,271

[22] Filed: Sep. 4, 1996

[30] Foreign Application Priority Data

Oct. 6, 1995 [DE] Germany ..... 195 37 173.9

[51] Int. Cl.[6] ..... B26D 1/00

[52] U.S. Cl. ..... 83/82; 83/102; 83/105; 83/307.3; 83/651.1

[58] Field of Search ..... 83/79, 81, 82, 83/102, 102.1, 105, 112, 113, 119, 155, 307.1, 307.2, 307.3, 355, 651.1

[56] References Cited

U.S. PATENT DOCUMENTS

| | | | |
|---|---|---|---|
| 4,062,114 | 12/1977 | Luick | 30/347 |
| 4,084,469 | 4/1978 | Gray | 83/651.1 |
| 4,086,700 | 5/1978 | Inada | 30/347 |
| 4,171,724 | 10/1979 | Steele | 30/347 |
| 4,905,465 | 3/1990 | Jones et al. | 30/276 |

FOREIGN PATENT DOCUMENTS

| | | |
|---|---|---|
| 141156 | 5/1985 | European Pat. Off. . |
| 554339 | 8/1994 | European Pat. Off. . |
| 0674045 | 9/1995 | European Pat. Off. . |

*Primary Examiner*—Maurina T. Rachuba

*Attorney, Agent, or Firm*—Ostrolenk, Faber, Gerb & Soffen, LLP

[57] ABSTRACT

A strip severing device for a feed strip to be threaded in a machine for producing or processing a paper web. The device has a swingably mounted guide plate for the guiding of the feed strip selectively toward or away from a web separating device. The separating device has a support element which can be rotated. It carries at least one flexible or flexibly supported separating element which swings out from a position of rest into an operating position in which it severs the feed strip coming from the guide plate.

16 Claims, 4 Drawing Sheets

STRIP SEVERING DEVICE FOR PAPER WEB

BACKGROUND OF THE INVENTION

The present invention relates to a strip severing device for a feed strip which is to be threaded in a machine for producing or processing a web, particularly a paper web, and particularly to a separating device for the strip.

Strip severing devices and severing methods of the type disclosed here are known, for example from EP 0674045A2, incorporated by reference. They have at least one guide plate which transfers the web and the feed strip during starting of machine operation and after a tear occurs in the web. In order to cut off the web which runs off before the web is transferred into a collection region, cutting means are provided within the region of swing of a swingable guide plate which transfers the web. The cutting means typically have two knife edges which cooperate to sever the discharging web and enable its being taken over.

It has been found that, even when the known machine has been stopped, the knives in the cutting region present a great risk of injury. This applies also to other separating devices having movable knives.

SUMMARY OF THE INVENTION

It is therefore the object of the invention to provide a strip severing device having cutting means which present practically no danger of injury.

This object is achieved by a strip severing device which comprises a separating device including a flexible separating element. Because the cutting device has at least one flexibly developed separating element, this practically entirely excludes the danger of operator injury when the web or paper manufacturing machine is stationary. Even during operation of the strip severing device, the danger of injury is reduced since the cutting device cuts the web or feed strip by itself, without a mating element, in contrast with the prior art where two knife edges cooperate.

In a preferred embodiment of the strip severing device, the separating element is itself flexible. This minimizes the danger of injury as a result of the special development of the separating element. The strip severing device can therefore be developed very simply and can operate reliably but also relatively safely.

A further preferred embodiment of the strip severing device has the separating element arranged resiliently on a support element. The separating element can therefore deflect and carry out an evasive movement which reduces the danger of injury to a minimum and thereafter resiliently return to its previous orientation.

In a further preferred embodiment of the strip severing device, the separating device has at least one separating element which can be brought into a position of rest, substantially reducing the danger of injury. In the position of rest, the arrangement of the separating elements avoids injury to operating personnel. The separating elements can, however, be moved from this position of rest into an operating position at which they sever a feed strip which runs off the guide plate.

In a particularly preferred embodiment of the strip severing device, the separating element is developed as an elongated plastic wire having one proximal end arranged on a support element which can be rotated and a second distal end, the end facing away from the support element, which can be moved from a rest position into an operating position.

When the support element is stationary, the end of the wire does not present any danger of injury to the operating personnel. It may simply hang down. Even when the cutting device is operating, the danger of injury is reduced by the fact that the free end, which severs the feed strip, can deflect and move away upon striking the body of an operator, so that at least severe injuries can be avoided.

Another object of the invention is to provide a method for severing a feed strip which is to be threaded in a machine for producing or processing a web, and particularly a paper web, to substantially exclude the danger of injury.

Because the feed strip is severed by a flexible separating element of a separating device, the danger of injury is minimized. If an operator comes into contact with the separating element, either when the strip severing device is stationary or when it is in operation, injuries, and particularly severe injuries, are practically impossible due to the deflection or evasive movement of the separating element. This differs from the situation with stationary, rigid knives.

Other features and advantages of the present invention will become apparent from the following description of the invention which refers to the accompanying drawings.

DESCRIPTION OF PREFERRED EMBODIMENT OF THE INVENTION

Figure 1A:
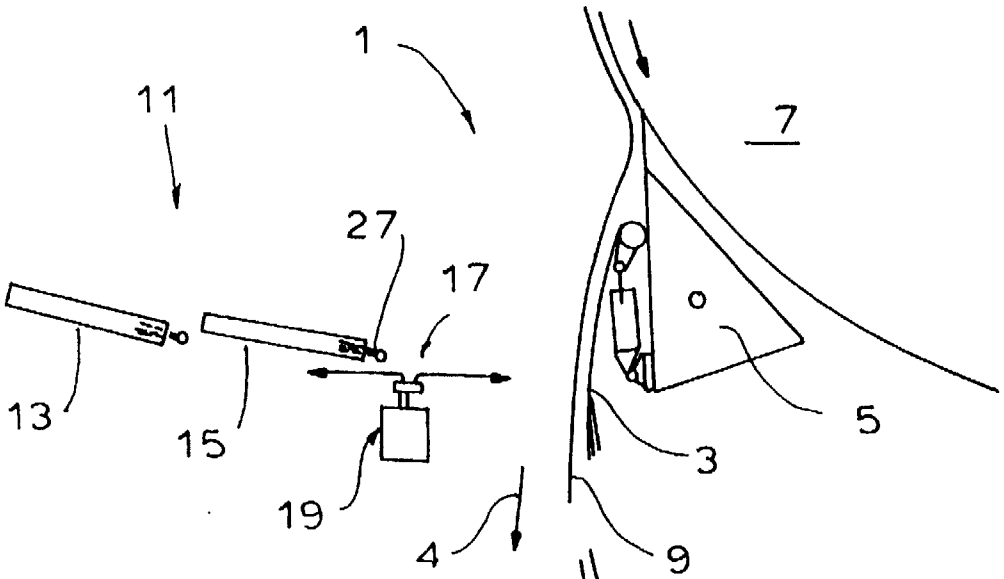
FIGS. 1*a*, *b* and *c* show, in very diagrammatic fashion, three operational positions for a strip severing device.

For the background details of a strip severing device, the above noted EP 0674045A2 may be reviewed. FIG. 1 hereof shows three operating positions of a strip severing device 1. The device cooperates here with a transfer device which has a guide plate 3, known also as a table plate, which is arranged swingably on a scraper beam 5 of a machine (merely indicated here) for producing or processing a web, particularly a paper web 9. The web 9 comes off a roll 7.

Upon placing the machine in operation or upon a tear occurring in the web, the web 9 travels over the guide plate 3, which is shown in FIG. 1*a* swung down into its position of rest. From the plate 3, the web moves into a receiving region which is present below the machine.

Before the start of a transfer process, a feed strip or tail which is to be conducted through the machine is cut in known manner from the web of material 9. As soon as the feed strip has been conducted completely through the machine, the width of the web of material is returned to the desired size, namely to the total width.

Receiving or guide means 11 to the left of the guide plate 3 in FIG. 1*a* take over the web of material 9 or the feed strip. In this case, two guide plates 13 and 15 are shown. At the end 17 facing the scraper beam 5 there is a cutting device 19 which is used to cut off the web of material 9 during a transfer process.

Figure 1B:
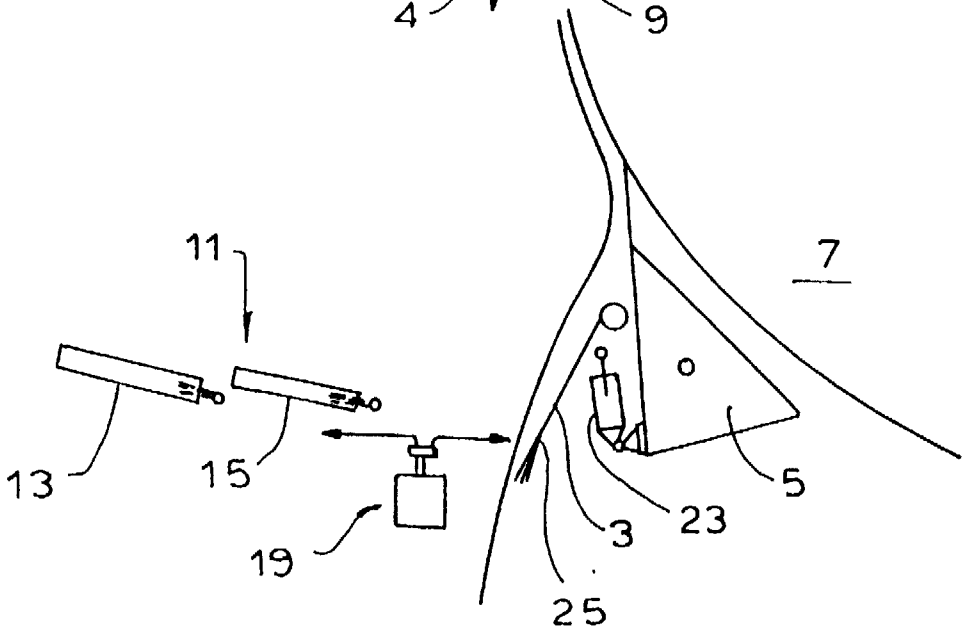

Before being threaded, the web of material 9 travels, as indicated by arrow 4, downward along the the guide plate 3 in FIG. 1*a*. For transferring the web 9, the guide plate 3 is swung by a swinging device 23 in the clockwise direction in FIG. 1 out of its starting position, shown in the top sketch in FIG. 1*a*. The web of material 9 coming from the free end 25 of the guide plate 3 passes into the region of action of the cutting device 19 and is thereby severed. The middle sketch FIG. 1*b* shows the guide plate 3 in a transition position in which the web of material 9 is just about to be cut off. The guide plate 3 is then swung beyond this position, as shown in the bottom sketch FIG. 1*c*, so that the web of material 9 comes into the region of the receiving or guide device 11, where it is first taken over by the guide plate 15.

Figure 1C:
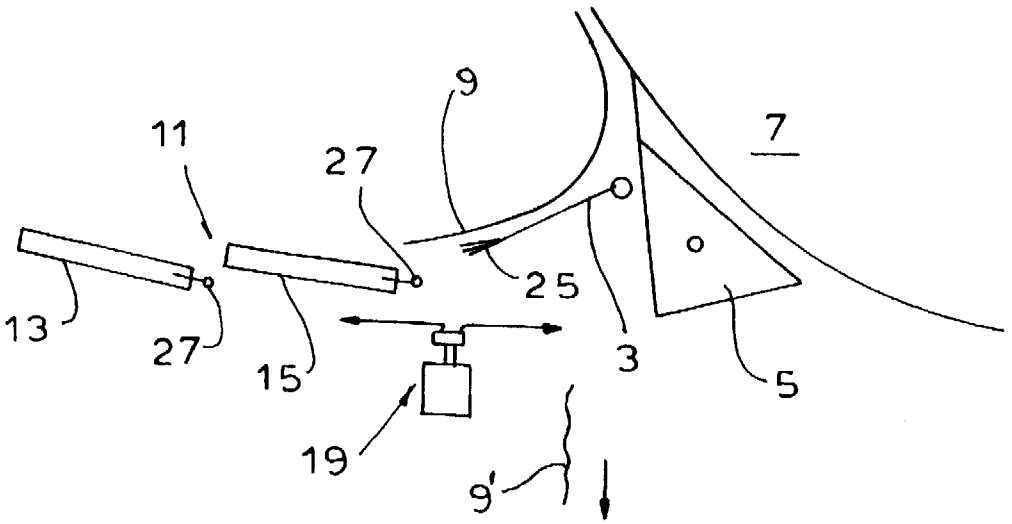

In FIG. 1*c*, an end 9' has been severed from the web of material 9, so that the web of material 9 can be received by the receiving or guide device 11.

Known blowing means 27 support the guidance of the web. Being known, a description of their operation can be dispensed with.

The guide plate 3 remains upraised in the position shown in FIG. 1*c* until the web 9 is taken over by a following roll (not shown) of the web producing or processing machine. The guide plate 3 can then be swung back into its starting position, shown in FIG. 1*a*. It is then also possible to inactivate the cutting device 19 and the blowing means 27.

Figure 2:
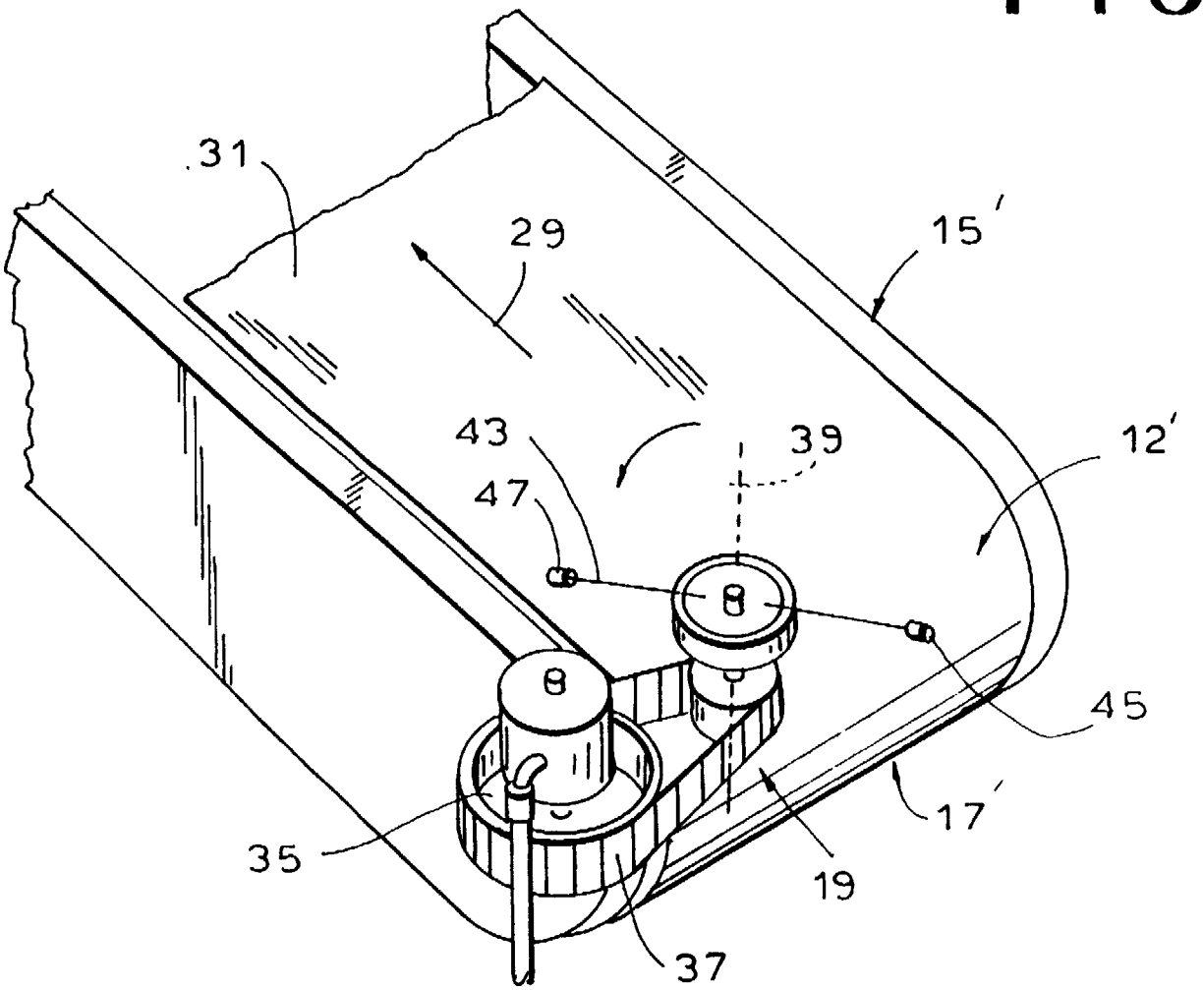
FIG. 2 is a perspective partial view of a first embodiment of the strip severing device shown in FIG. 1.

Belt devices can also be provided instead of the guide plates 13 and 15. The surfaces of the belt devices facing the web of material 9 move in the direction of transport of the web of material. Such a belt device is shown in FIG. 2. Its manner of operation corresponds to that of the guide plates 13, 15 in FIG. 1. FIG. 2 shows a belt device 15' which receives the web of material 9 coming from the guide plate 3 and conducts it further. In FIG. 2, the direction of movement of the course 31 of the belt device 15' which guides the web 9 is indicated by arrow 29. On the end 17' of the belt device 15' facing the guide plate 3, there is a cutting device 19 as indicated in FIG. 1. It has a support element 33 which can be rotated by a suitable drive like motor 35, via a suitable force transmission device, for instance, via a toothed belt 37. The direction of rotation is as desired. It is assumed here that the support element 33 in FIG. 2 turns in the counterclockwise direction around an axis 39.

Two oppositely extending separating elements 41 and 43 are arranged on the support element 33. The first inward end of the separating elements 41, 43 are fastened in suitable manner on the support element 33. The second outward ends, their distal ends, protrude beyond the outer limiting surface of the support element 33 when the support element 33 rotates.

In this embodiment, weights 45 and 47 are provided on the distal ends of the separating elements 41 and 43.

Figure 3:
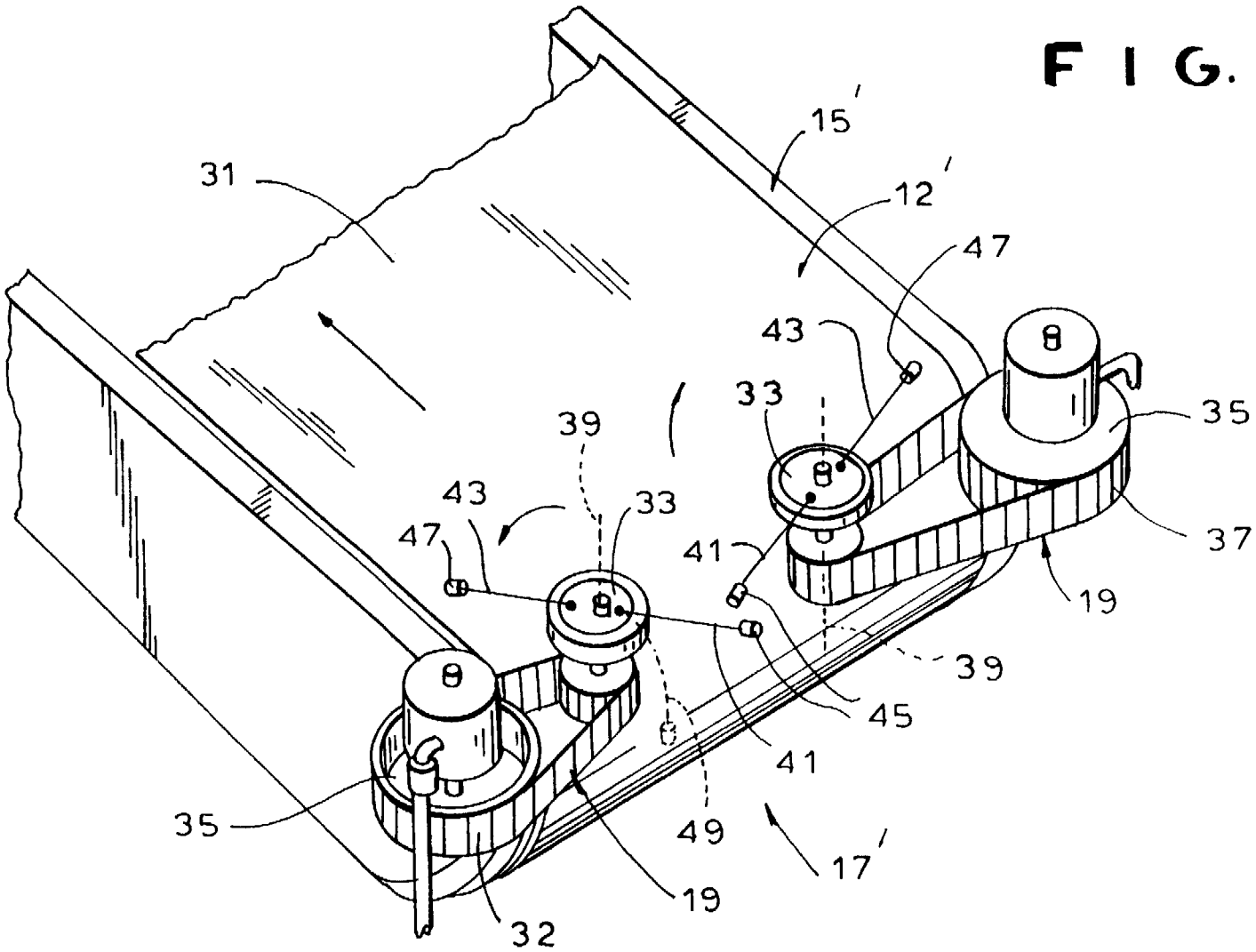
FIG. 3 is a perspective view of a second embodiment of the strip severing device shown in FIG. 1.

FIG. 3 shows a part of a receiving or guide device. Instead of the guide plate in FIG. 1, the guide device comprises a belt device 15' onto which the web of material 9 is applied from the table or guide plate 3. Two separating devices 19 are provided at the end 17' of the belt device 15' facing the guide plate 3. The separating devices are approximate mirror images of each other. To the side of the course 31 which receives the web of material 9, there are motors which serve as the drive 35. Each places its respective support element 33 in rotation and the support elements 33 are driven in opposite directions. The support elements 33 are arranged within the lateral limiting edges of the course 31.

Both of the support elements 33 are provided with two separating elements 41 and 43 which are provided with weights 45 and 47 at their ends facing away from their support element 33. FIG. 3 also shows the separating devices 19 in their operative positions, that is, the separating elements 41 and 43 are swung out substantially perpendicular to the axis of rotation 39 of the support elements 33. FIGS. 2 and 3, therefore, show the separating elements 41 and 43 in their operating positions in which they can sever a web of material 9 which is transferred by the guide plate 3.

In FIG. 3 the rest position 49 of a separating element 41 is shown in dashed line at the left separating device. The weight 45 at the end of the element 31 bends the separating element 41 downward under gravity. In the separating devices 19, the separating elements 41, 43 are all developed so that when the support elements 33 are stationary, they assume the rest position 49 indicated.

Figure 4:
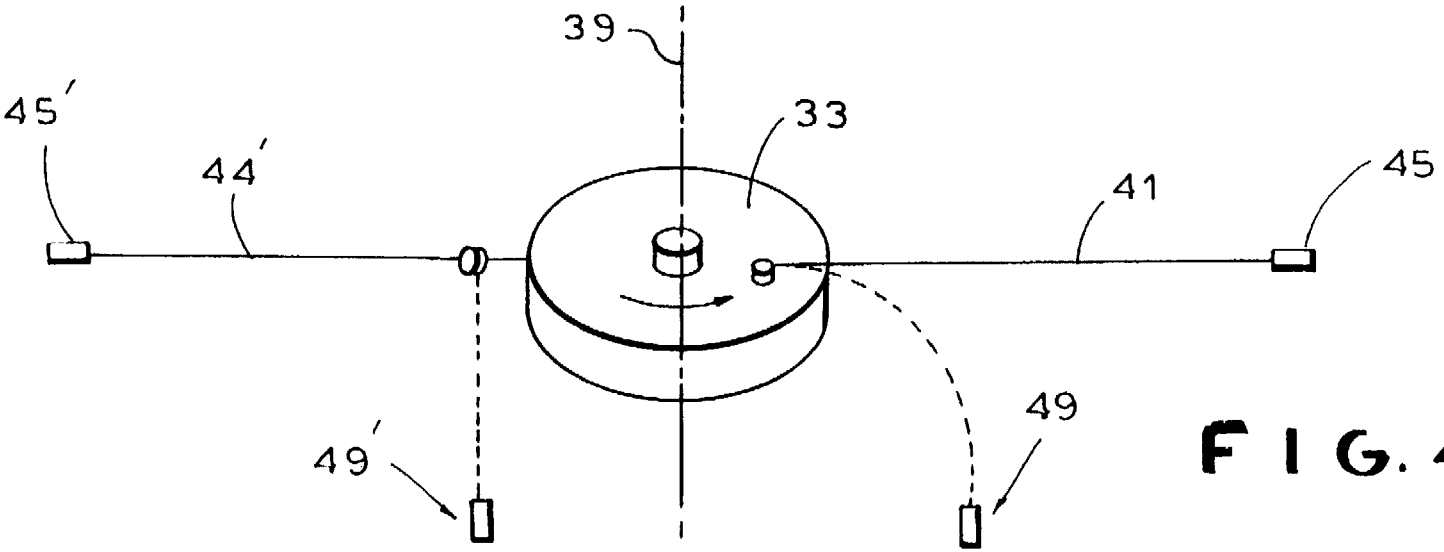
FIG. 4 is a perspective partial view of a support element for separating elements.

FIG. 4 shows a part of a separating device 19, namely a support element 33 for separating elements. Other embodiments of separating elements can also be used.

On the right hand side of the support element 33, there is a separating element 41 which, as explained with reference to FIGS. 2 and 3, has a weight 45 on its distal end. The working position of the separating element 41 is shown in solid line. Its rest position 49 is shown in dashed line.

The separating element 41 is comprised of a flexible yet resilient material. However, it is also possible to use separating elements 41' which are substantially rigid and which are arranged swingably in suitable manner on the support element 33. In FIG. 4, it is assumed that the separating element 41' also carries a weight 45' at its distal end facing away from the support element 33. Upon rapid turning movement of the support element 33 around its axis of rotation 39, the separating element 41' is swung outward into its working position, substantially perpendicular to the axis of rotation 39 by centrifugal force. When the support element 33 is stationary, the separating element 41' droops into its rest position 49' and hangs substantially vertically downward.

The swingable suspension of the flexible separating element 41' on the support element 33 prevents injury which might be caused by the weight 45', even possibly if no weight is developed with sharp edges, since the separating element 41' can deflect and move away upon contact with an operator.

The same description applies, of course, to the separating element 41 which is made of a flexible, yet resilient material and which is also bent downward by the weight 45 when the support element 33 is stopped.

Furthermore, there is the possibility of developing the separating element 41 from a flexurally resilient material in such a manner that, when the support element 33 is at rest, the element is not bent downward, but due to the stiffness of its material, it instead remains continuously in its operating position. Yet, it is a flexible enough element as to deflect when it contacts any other solid object, like an operator.

The separating device 19 explained with reference to FIGS. 1 to 4 is intended to not present any risk of injury to the operator when the support element 33 is at rest. The separating elements 41 and 41', which may also be developed with a sharp edge at their ends, swing into their positions of rest 49 and 49', respectively, and thus protrude only slightly beyond the outer limiting surface of the support element 33. Furthermore, the ends of the separating elements 41 and 41' are movable and deflectable with respect to the support element 33, so that they can carry out a deflection or evasive movement if an operator contacts them. This evasive movement would also be carried out by the separating element 49 which remains continuously in its operating position. Due to its physical properties, the element 49 has sufficient flexibility to deflect and at the same time such stiffness that it is not bent by its own weight, as a result of the force of gravity. Even if the separating device 19 is in operation and the support element 33 turns so fast that the separating elements 41 and 41' are moved into their operating positions, the ends of the separating elements protruding beyond the outer limiting surface of the support element 33 can still deflect or carry out evasive movement if part of an operator comes into the travel circle of the distal second ends of the separating elements 41, 41'.

Plastic has proven suitable as the basic material for the separating elements 41 and 43. Wires or wire ropes may be used which are so flexible that the separating elements 41, 43, particularly if they are provided with weights at their ends, are bent downward or droop when the support element 33 is at rest so that the danger of injury is practically avoided.

It is particularly advantageous that the length of the separating elements 41, 41' and 43 respectively can be easily varied without requiring any structural change in the elements 41, 41', 43 themselves. In this way, the operating width of the separating elements 41, 41', 43 can easily be changed.

In a particularly preferred separating device 19, the number of separating elements 41, 43 is selected to avoid an imbalance. It is also possible, in the case of separating devices 19 having a single separating element 41, 43, to arrange a corresponding counterweight on the support element 33 in order to avoid imbalance.

To improve the severing action of the separating device 19, it is possible to mount the support element 33 eccentrically with respect to its predetermined axis of rotation 39. In this way, the outermost end of a separating element 41, 43 is acted on by an additional striking force based on the eccentricity.

The stiffness of the separating elements 41, 43 and the amount of the weight provided on the end of the separating element 41, 43 can be adapted to the properties of the web of material to be separated. For very light webs of paper, it is possible to dispense with the weights. For heavier webs, the weights, which are otherwise without cutting edges, are developed with respective sharp edges at their radially outer side in order to increase the severing action. This also reduces the danger of injury to operating personnel, even upon operation of the separating device 19, since no stationary knives are used. Due to their flexibility, i.e. because of the resilience of the separating elements 41, 43 or due to their swingable suspension, the ends of the separating elements 41, 43 can still deflect and carry out evasive movement when they come against the body of an operator.

Finally, the support element 33 shown inter alia in FIG. 4 can also be modified as follows: Radially extending recesses can be arranged, for instance, in the base body of the support element 33. Separating elements 41, 43 are introduced into those recesses. These elements can be anchored by an element of spring elasticity on the support element 33 which strikes the separating elements 41, 43 with a force of retraction. If the support element 33 is placed in rotation, the separating elements 41, 43 can emerge out of the recesses against the force of retraction and sever a web of material moving past the support element 33. In their retracted positions, the separating elements 41, 43 cannot present any danger of injury to the operating personnel, providing a high degree of safety in operation. The separating elements might be held retracted fully within the support element and emerge due to the high centrifugal force of the spinning.

In view of the foregoing, it is practically impossible to injure operating personnel with the strip severing device 1 described.

This advantage is also provided by a method for severing a feed strip to be threaded in a machine for producing or processing a web, particularly a paper web. The feed strip is severed by a flexible separating element 41, 43 of a separating device 19. Squeezing or injuring of the operator between two knife edges cooperating with each other will not occur. Other knives acting without a mating element on the feed strip can also be dispensed with, since the flexible separating element 41, 43 reliably severs the feed strip.

The method can be carried out without rigid knives, which could provide a risk of injury even at standstill.

In FIGS. 1 to 4, the flexible separating elements 41, 43 used can be developed either flexible or resilient in themselves or be suspended flexibly, for instance swingably.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A strip severing device for a feed strip that is to be threaded in a machine for producing or processing a paper web, the strip severing device including a web separating device adapted for separating the web, the separating device including a flexible separating element sufficiently strong to cut the web and sufficiently flexible to deflect upon contacting an obstructing body, and means moving the separating element against the web to cut the web.

2. The strip severing device of claim 1, wherein the separating device moves with reference to the web for severing the web;

the separating element being flexible to flex as it is moved when it contacts an obstructing body.

3. The strip severing device of claim 1, wherein the device comprises a support element for the separating element and the separating element is supported flexibly on the support element to deflect with reference to the support element upon the separating element contacting an obstructing body.

4. The strip severing device of claim 1, wherein the device further comprises a support element, means for rotating the support element;

the separating element being supported on the support element for being swung as the separating element is rotated along with the support element, wherein such rotation of the separating element causes the separating element to sever the web.

5. The strip severing device of claim 4, wherein the separating element is sufficiently flexible that when the support element rotates, the separating element is displaced with respect to the support element from a rest position at which it is out of the way and will not the sever the web to an operating position at which it is in position to sever the web.

6. The strip severing device of claim 5, further comprising means for directing the web along a web path which avoids the separating element of the severing device, and deflecting means for deflecting the web toward the separating element to position the web to be severed.

7. The strip severing device of claim 6, further comprising means for supplying the web, and the deflecting means comprises a guide plate mounted and operable for moving the web toward the separating element.

8. The strip severing device of claim 5, wherein the separating element is elongated and threadlike in shape and has a first end supported on the support element and an opposite second end away from the support element, the second end being swung out from the support element to position the separating element in a web separating position.

9. The strip severing device of claim 8, wherein the support element has a first peripheral shape with reference to the separating element and the separating element being of a length such that as the separating element and the support element are being spun, the second end of the separating element protrudes beyond the periphery of the support element.

10. The strip severing device of claim 8, further comprising a weight at the outward end of the separating element enhancing its ability to swing outward.

11. The strip severing device of claim 10, wherein the separating element is comprised of a flexible thread, wire or rope.

12. The strip severing device of claim 8, wherein the separating element is comprised of a flexible thread, wire or rope.

13. The strip severing device of claim 8, wherein the separating element is itself a rigid element, and the separating element is flexible with reference to the support element, a swingable connection between the separating element and the support element for providing the flexibility of the separating element.

14. The strip severing device of claim 8, further comprising a plurality of the separating elements supported on the support element to extend outwardly from the support element in different directions upon rotation of the support element.

15. The strip severing device of claim 14, comprising at least of the two separating elements projecting in opposite directions from the support element.

16. The strip severing device of claim 8, further comprising a plurality of the severing devices arranged across the width of the web and guide means guiding the web to the strip severing devices.

* * * * *